US005853104A

United States Patent [19]

Rathjen

[11] Patent Number: 5,853,104

[45] Date of Patent: Dec. 29, 1998

[54] COMBINATION FOOD PLATE AND BEVERAGE-HOLDING ARTICLE

[76] Inventor: Kris M. Rathjen, 7031 Elizabeth Dr., McLean, Va. 22101

[21] Appl. No.: 833,501

[22] Filed: Apr. 9, 1997

[51] Int. Cl.[6] ..... A47G 19/00

[52] U.S. Cl. ..... 220/574; 220/23.83; 220/23.86

[58] Field of Search ..... 220/574, 23.83, 220/23.86

[56] References Cited

U.S. PATENT DOCUMENTS

| | | | |
|---|---|---|---|
| Re. 27,688 | 6/1973 | White et al. . | |
| D. 150,666 | 8/1948 | Zachary . | |
| D. 157,700 | 3/1950 | Price . | |
| D. 301,820 | 6/1989 | Wasserman . | |
| 2,117,102 | 5/1938 | Pittler | 220/574 X |
| 3,250,422 | 5/1966 | Parish | 220/23.83 |
| 3,381,825 | 5/1968 | Bessett . | |
| 3,498,470 | 3/1970 | Thomas . | |
| 3,955,672 | 5/1976 | Brundage . | |
| 4,043,478 | 8/1977 | Duncan . | |
| 4,461,396 | 7/1984 | Harper . | |
| 4,607,758 | 8/1986 | Stevens | 220/23.83 |
| 4,938,373 | 7/1990 | McKee | 220/23.86 |
| 4,966,297 | 10/1990 | Doty . | |
| 5,060,820 | 10/1991 | Boerner . | |
| 5,110,170 | 5/1992 | Boatwright . | |
| 5,207,743 | 5/1993 | Costarella et al. | 220/574 |
| 5,234,125 | 8/1993 | Roberts | 220/574 |
| 5,249,700 | 10/1993 | Dumke | 220/574 |
| 5,259,528 | 11/1993 | Pace et al. . | |
| 5,335,787 | 8/1994 | Finchum et al. . | |
| 5,397,089 | 3/1995 | Kataoka . | |
| 5,419,455 | 5/1995 | Russeau . | |
| 5,429,231 | 7/1995 | McSpadden . | |
| 5,441,164 | 8/1995 | Beck et al. . | |
| 5,598,944 | 2/1997 | Aragona . | |

*Primary Examiner*—Steven M. Pollard
*Attorney, Agent, or Firm*—Nixon & Vanderhye

[57] ABSTRACT

The combined food plate and beverage-holding article comprises a generally flat compartmentalized rib-reinforced plate body having an upstanding truncated cone. The cone has an open upper end for receiving a beverage container. A support base is pivoted inside the member between a first position lying horizontal adjacent the base of member 14 to support a beverage container received through the upper opening and a second position lying against an interior wall of the member for use with stem glasses wherein the bowl may be supported by the upper margin of the member and the flat base of the stem glass to extend through the open lower end of the member. The support base may be locked in a first position and releasably retained in its second position. A slot is formed adjacent the base of member 14 for receiving and supporting the flat base of a stem glass having a bowl smaller in diameter than the diameter of the upper opening of the member.

23 Claims, 4 Drawing Sheets

Fig. 2
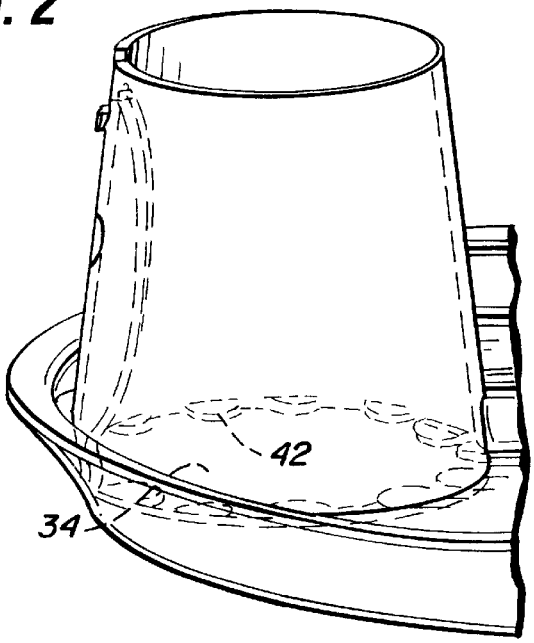
Fig. 4a
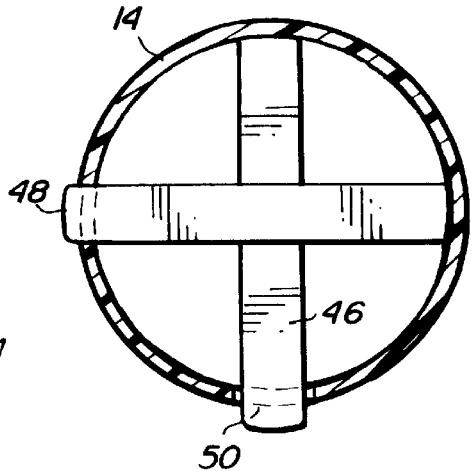
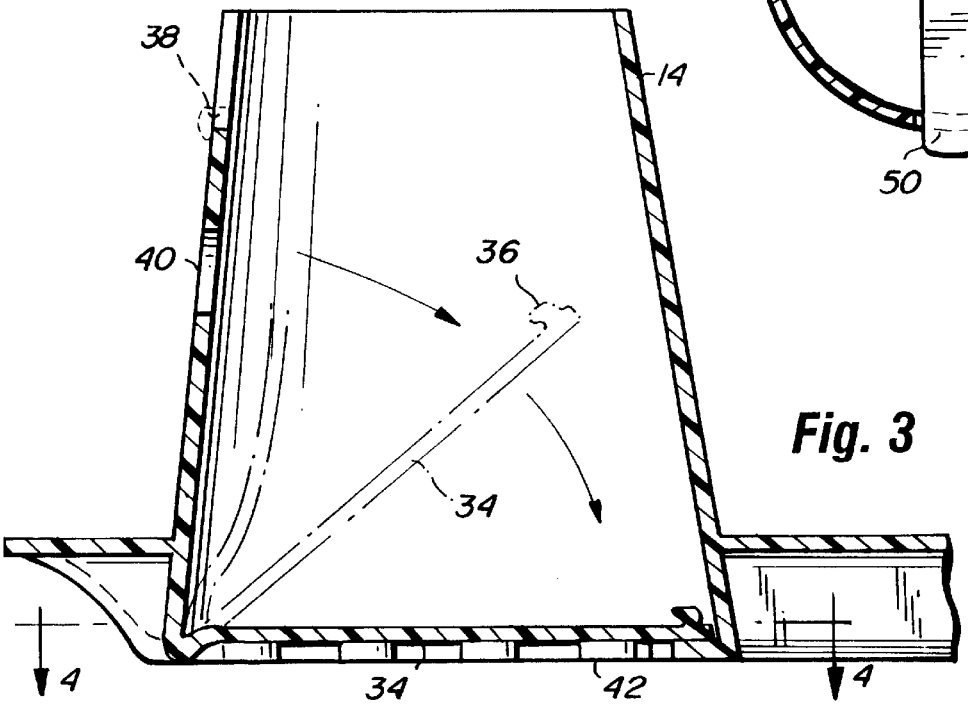
Fig. 3

Fig. 4
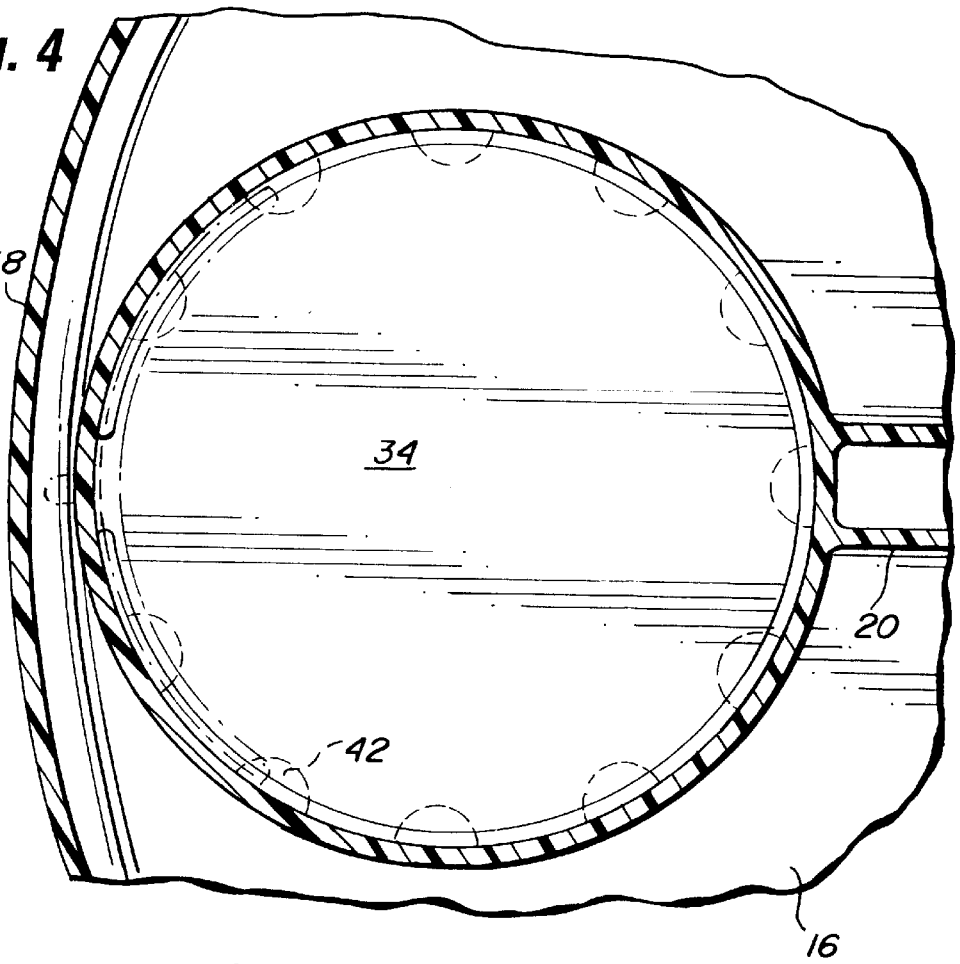
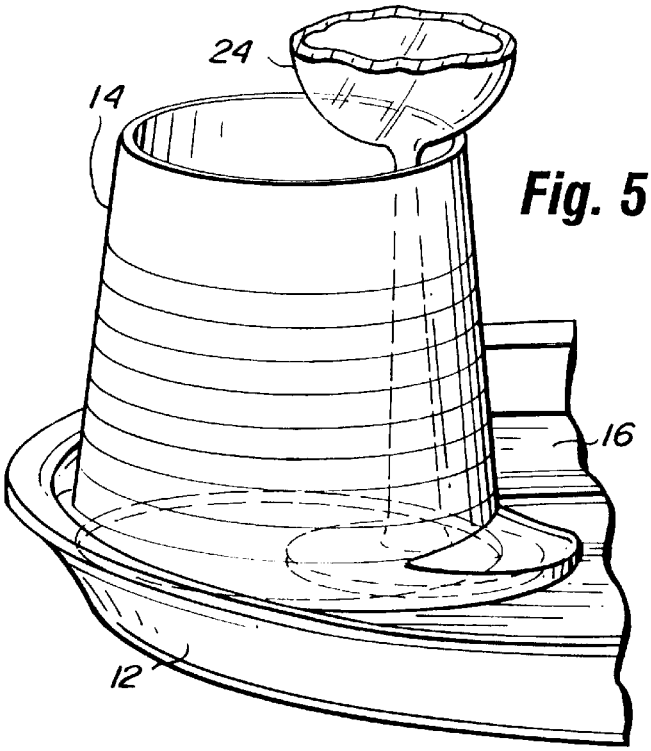
Fig. 5
Fig. 6
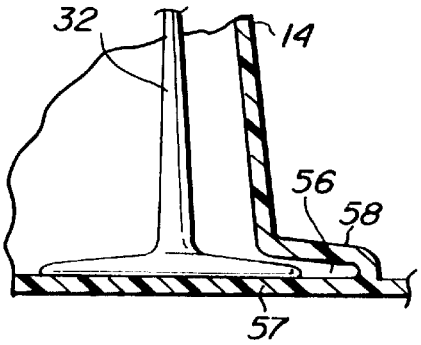

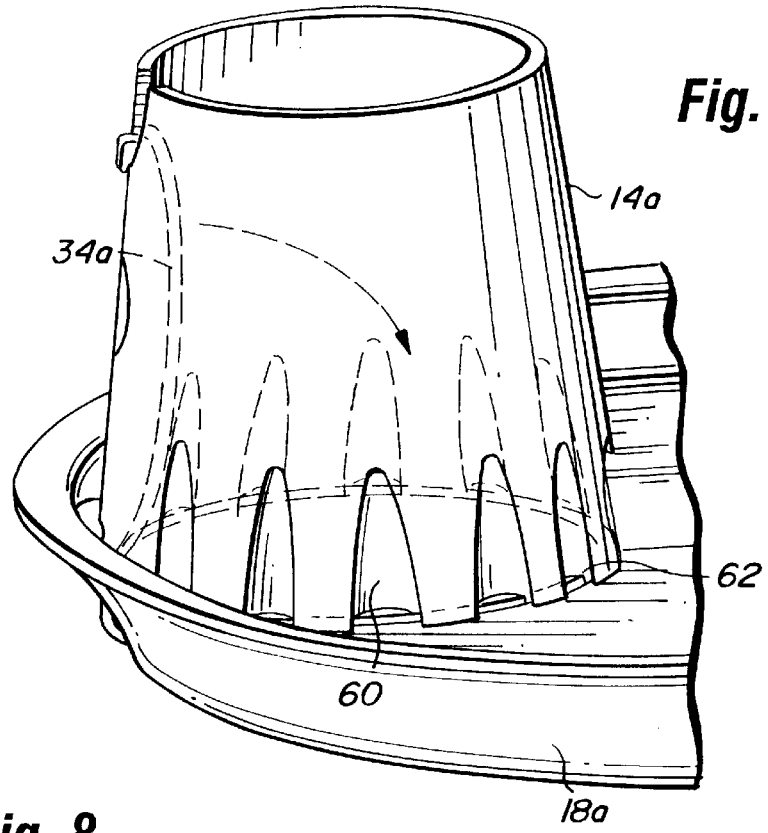
Fig. 7
Fig. 8
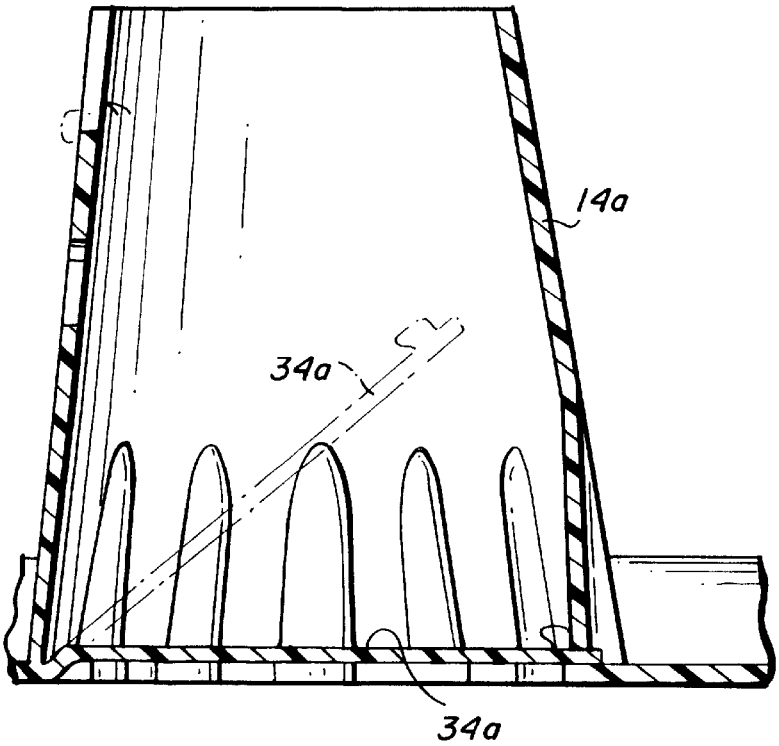
Fig. 9
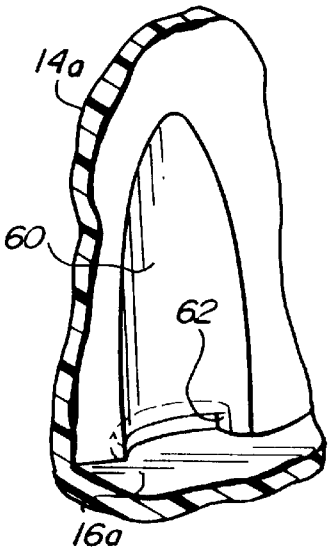

COMBINATION FOOD PLATE AND BEVERAGE-HOLDING ARTICLE

TECHNICAL FIELD

The present invention relates to a combined food plate and beverage-holding article for facilitating the carrying of food and a beverage in one hand and particularly relates to nestable or stackable combined food plate and beverage-holding articles to facilitate storage thereof.

BACKGROUND

A substantial number of proposed designs have attempted to solve the problems associated with simultaneously carrying food on a plate and a beverage container in one hand. For example, at parties, gatherings, socials, receptions and the like, it is commonplace to pass along a buffet with a plate in one hand and a beverage container in another hand. In order to serve the food onto the plate, the plate or beverage container must be set down and the other hand used in the serving process. Alternatively, attempts can be made to grasp both the plate and the beverage container in one hand. Obviously, if the plate and the beverage container are separate, great difficulty is encountered in attempting to balance the beverage container typically on the plate while serving food onto the plate. Similar problems occur when an individual attempts using a utensil to eat from the plate or to drink from the beverage container. Current designs of combined food plate and beverage holders fall considerably short of solving these problems.

For example, certain designs still require the individual to grasp both the beverage container and the plate with one hand, typically requiring the user to surround the beverage container with the thumb and forefinger, while holding the tray with the other portions of the same hand. Substantial manipulation of the individual's hand and fingers are required to remove the beverage container from its position between the thumb and forefinger, while at the same time balancing or attempting to balance the food on the plate. These changes in gripping the plate and beverage container, while simultaneously avoiding spillage is difficult at best and oftentimes results in spilled food and/or beverage.

On certain occasions, another problem presents itself in that stem glasses are typically used. Stem glasses are even more difficult to handle and manipulate due to the nature of the glass itself, i.e., a bowl at the top, a flat base at the bottom and very thin stem interconnecting the bowl and base. Combined food plate and beverage-holding articles specifically accommodating stem glasses are known but inadequate. Certain designs accommodate stem glasses by securing the base of the stem glass to the food plate. Oftentimes, horizontal removal of the stem glasses from the plate is required, again necessitating the use of two hands in order to separate the stem glass from the food plate. Also, stem glasses are sometimes simply placed in a defined receptacle or simply an open area within the food plate body, which more often than not results in spilling the contents of a stem glass or causing it to tip over. Further, those known combined food plate and beverage-holding articles do not accommodate different types of beverage containers, e.g., cans, bottles, stem glasses, cups and the like, and certain of such articles are designed for use with a particular type of beverage container, for example, a stem glass only. The nestability or stackability of the combined food plate and beverage-holding articles is also a highly desirable characteristic which often is not found in such prior articles due to the unique nature of the construction necessary to accommodate both the food plate and beverage container.

DISCLOSURE OF THE INVENTION

In accordance with the present invention, there is provided a novel and improved combined food plate and beverage-holding article which minimizes or eliminates the foregoing and other problems associated with prior combination food plate and beverage-holding articles and affords various advantages in construction and use, as will now be explained. In the present combined food plate and beverage-holding article, there is provided a food plate body having a generally peripherally upstanding lip to confine the food on the plate. The plate body may have a number of upstanding ribs which divide the plate into separate compartments and afford strength to the plate. Off-center and toward one side of the plate body, there is provided a truncated cone upstanding from the plate body having a lower end of larger diameter than the diameter of its open upper end. The member is specifically sized such that the upper smaller diameter end may receive beverage containers such as bottles or cans, while at the same time provide support for the bowl of stem glasses when the stem glasses, including their base and stem, are received through the upper opening. Further, the upper opening is sized to receive the lower inverted frustoconical shape of commercially available cups so that the flange typically found intermediate the upper and lower ends of the cups may rest on the margins of the truncated cone.

To enable the cans or bottles, once passed through the upper opening of the member, to be supported, the member includes a support base which is movable between a first position substantially closing the bottom of the member and providing a support for a beverage container, e.g., a can or bottle placed within the member and a second open position such that the lower portion of a stem glass, for example, its base and stem, may pass entirely through the member with the glass being supported only from its bowl. More particularly, the support base is pivoted between a first position closing the opening in the lower part of the member to support the stem glass and a second position inclined within the member and bearing against an interior wall surface of the member. With the support base in the first position, the can or bottle received through the upper opening may come to rest on the base support in a plane parallel to the plane of the plate body. If a support for a stem glass is required, the support base may be left in its upward second position whereby the reduced diameter margin of the member about the upper opening engages and supports the bowl of the stem glass. In the event that the bowl of the stem glass is smaller in diameter than the diameter of the upper opening, the support base can be placed in the horizontal position to support that type of stem glass. Alternatively, a slot may be provided in the member adjacent its base such that a portion of the flat base of the stem glass may be received in the slot thereby supporting the stem glass.

It will be appreciated that an individual may grasp the article by solely gripping the frustoconical member or dividing his/her fingers between the frustoconical member and a location below the plate. Thus, the plate and member may be held with comfort and ease without tilting the plate and beverage container and notwithstanding an imbalance on the plate caused by the weight of the food.

The article of this invention is particularly useful by individuals who have physical disabilities with an upper extremity, i.e., difficulty with grasping objects, or individuals limited to one normally functioning upper extremity. Carrying food and drink with current designs can pose problems and affect an individual's self-reliance when he or she is unable to carry the beverage and food tray with one hand without great difficulty. The present design is also an improvement on current combined food and beverage holders specifically by enabling the article to be readily and easily placed or set down on a table or flat surface with only one hand and without any portion of that hand or arm underlying the plate which would otherwise cause difficulty in manipulating the plate and setting the plate down.

It is a feature of the present invention to provide a combination food plate and beverage-holding article which can be stacked or nested with similarly constructed articles. To accomplish that, the truncated conical members of the articles may be inserted one within the other with the base support in its second position in order to nest the plates in generally spaced parallel relation one with the other. This reduces transportation and storage space while enabling, through the pivoted support base, the beverage-holding aspect of each article to accommodate various types of beverage containers such as stem glasses, cans, bottles and the like.

In a preferred embodiment according to the present invention, there is provided a combination food plate and beverage-holding article comprising a plate body for supporting food and having a generally upstanding lip substantially about the margin of the body and a beverage container support carried by the body and including a generally truncated cone-shaped member having a wall portion adjacent the plate body larger in diameter than an upper end portion thereof, the member extending upwardly above the lip and being located off-center relative to the plate body sufficiently such that at least a portion of the member extending upwardly of the plate body can be grasped by an individual's fingers above the lip of the plate, thereby facilitating the carrying of a plate with food thereon and a beverage container in the beverage container support.

In a further preferred embodiment according to the present invention, there is provided nestable combination food plate and beverage-holding articles comprising a plurality of plate bodies for supporting food thereon, each plate body having a generally upstanding lip substantially about the body and a beverage container support carried by the body, each beverage container support including a generally truncated cone-shaped member having a wall portion adjacent the plate body larger in diameter than an upper end portion thereof, each member extending upwardly above the lip and being located off-center relative to the plate body, each member being nestable within another member of an adjacent article by insertion of the truncated cone-shaped members one into the other whereby a plurality of the articles are stacked.

In a still further preferred embodiment according to the present invention, there is provided a combination food plate and beverage-holding article comprising a plate body for supporting food and having a generally upstanding lip substantially about the margin of the body and a beverage container support carried by the body and including a member generally upstanding from the plate body comprised of a surface of revolution open at its upper and lower ends, the member extending upwardly above the lip and being located off-center relative to the plate body sufficiently such that at least a portion of the member extending upwardly of the plate body can be grasped by an individual's fingers above the lip of the plate, thereby facilitating the carrying of a plate with food thereon and a beverage container in the beverage container support and a support base carried by the article, the support base being movable between a first position closing the opening therethrough at the lower end of the member for supporting a beverage container in the beverage container support and a second position opening the lower end of the member.

Accordingly, it is a primary object of the present invention to provide a novel and improved combination food plate and beverage-holding article which facilitates the handling of a combined food plate and beverage container with one hand and which may accommodate various sizes and types of beverage containers, as well as enable stacking or nesting of the containers for storage and transportation purposes prior to use.

BRIEF DESCRIPTION OF THE DRAWINGS

FIG. 2 is a fragmentary view of the article with the base support illustrated in a second position leaving open the bottom of the member;

FIG. 3 is an enlarged fragmentary cross-sectional view thereof illustrating the movement of the base port between the second and first positions thereof;

FIG. 4 is an enlarged cross-sectional view taken generally about on line 4—4 in FIG. 3;

FIG. 4*a* is a reduced cross-sectional view illustrating a bottom closure for the article according to a further form of the present invention;

FIG. 5 is a view similar to FIG. 2 illustrating a still further embodiment of the present invention;

FIG. 6 is an enlarged fragmentary cross-sectional view illustrating the support for the base of a stem glass in the embodiment of FIG. 5;

FIG. 7 is a view similar to FIGS. 2 and 5 illustrating a still further form of the present invention;

FIG. 8 is a fragmentary cross-sectional view thereof; and

FIG. 9 is an enlarged fragmentary cross-sectional view illustrating a detail of the embodiment of the invention illustrated in FIG. 7.

BEST MODE FOR CARRYING OUT THE INVENTION

Figure 1A:
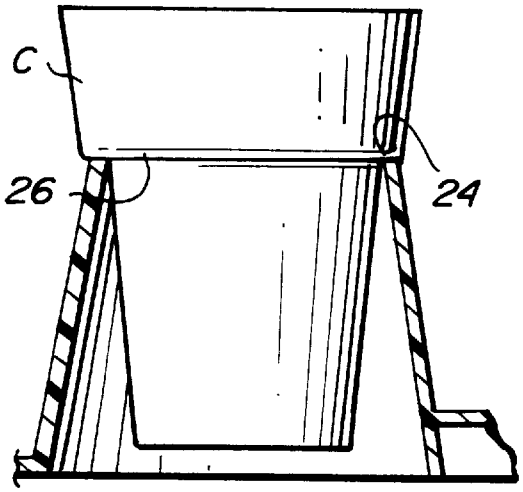
FIG. 1*a* is a fragmentary cross-sectional view of the beverage-holding portion of the article illustrating a cup being held by the article.
Figure 1:
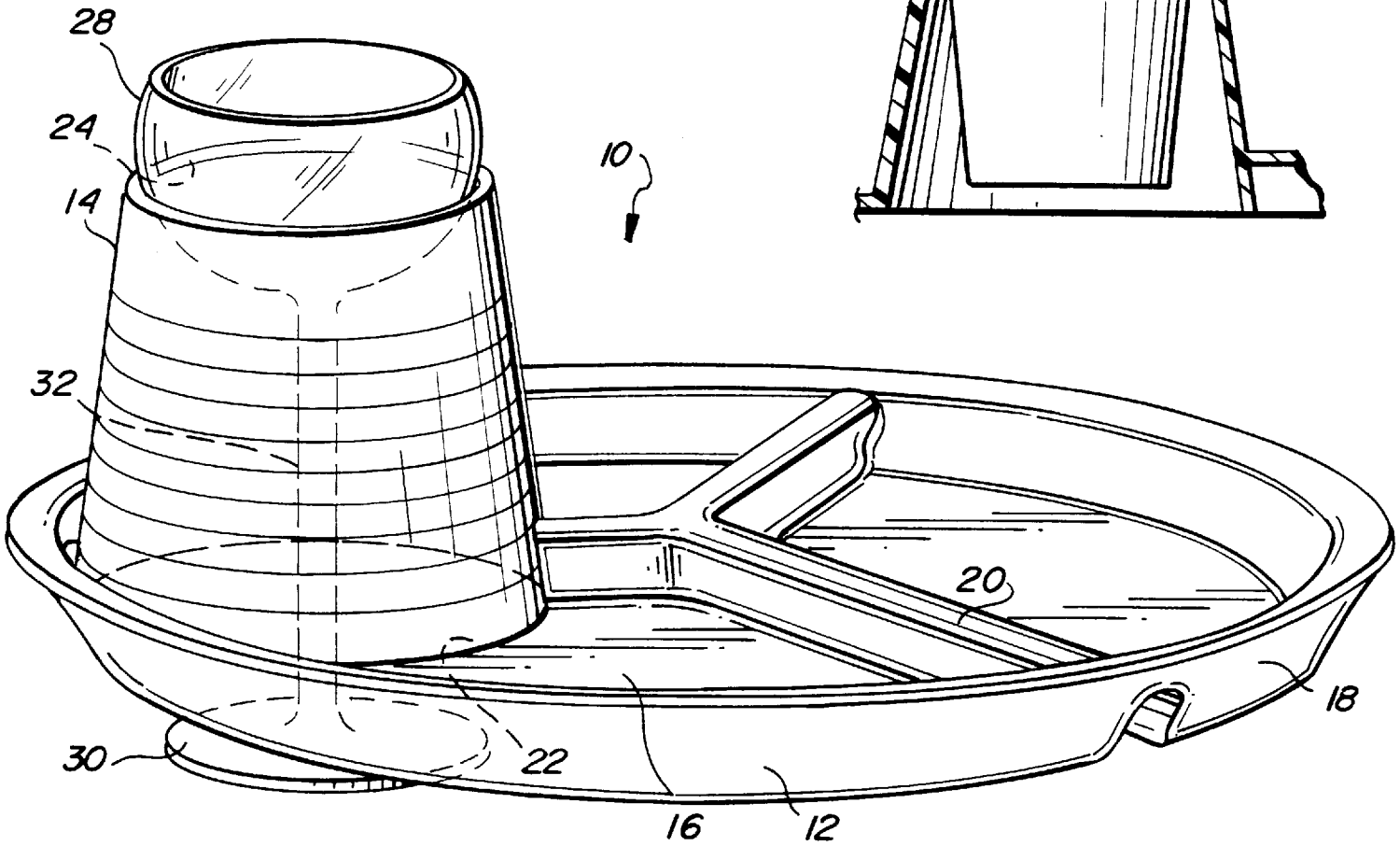
FIG. 1 is a perspective view of a combination food plate and beverage-holding article constructed in accordance with the present invention.

Referring now to the drawings, particularly to FIG. 1, there is illustrated a combination food plate and beverage-holding article, generally designated 10, and comprising a plate body 12 and a frustoconical beverage-holding member 14. As illustrated, the plate body 12 includes a generally flat or horizontal plate bottom 16 about which there is formed an upstanding lip 18. The portion of the lip 18 may share the same wall as part of the member 14. The plate body 12 includes a plurality of upstanding ribs 20 which divide the plate body into various compartments as illustrated and which ribs 20 also serve to reinforce the plate body 12.

Off-center from the center of the plate body 12 and lying to one side of the plate is a truncated conical beverage-holding member 14 having an opening 22 at its lower end larger in diameter than the opening 24 at its upper end. It will be appreciated from a review of FIG. 1 that the member 14 extends a substantial distance above the plate body 12 and typically may comprise four or five times the height of the plate body, including lip 18. In this fundamental form of the present invention as illustrated in FIG. 1*a,* the upper reduced diameter opening 24 may provide a support for a cup C placed in the opening, the cup having an outwardly directed flange 26 for resting on the margin of the upper opening 24. As illustrated in FIG. 1, a different type of beverage container may likewise be supported in this form of the invention. Thus, a stem glass having a bowl 28, a flat base 30 and a stem 32 interconnecting the bowl 28 and base 30 may be supported likewise by the margin of the reduced diameter opening 24 at the top of member 14. The base 30 may thus extend below the plate body 12.

It will be appreciated that from a review of drawing FIG. 1, an individual may grasp the member 14 readily and easily, thus supporting both the beverage within the member 14 and the plate body 12. The diameter of the member 14, while flaring outwardly in a downward direction, remains sufficiently small to enable an individual to grasp about the member 14 and thus support the plate body 12 and member 14 simultaneously with one hand. It will be appreciated that the member 14 can be provided with finger grips, for example, flutes formed in horizontal bands about member 14, to facilitate the gripping of member 14 by the individual. It will be appreciated that the member 14, while useful for supporting cups and stem glasses having large diameter bowls 28 may in that configuration have an upper opening larger in diameter than the diameter of a conventional beverage can or bottle. To accommodate the different sizes of beverage containers which may be held by the combined food plate and beverage holder of the present invention, a support base is provided in those instances where it is necessary to support a beverage container having a diameter less than the diameter of the upper opening through member 14.

In the illustrated and preferred form of the invention, a support base 34 is provided and is generally circular in configuration. Support base 34 is pivoted along one side to the base of the member 14 or to the plate body 12 as convenient and desired. As illustrated in FIGS. 2 and 3, the support base 34 is therefore pivoted between a first position lying generally horizontal and parallel to the plane of the plate bottom 16 and an upstanding, out-of-the-way position illustrated by the dot-dash lines of FIGS. 2 and 3 and bearing against the interior surface of the walls of member 14. A catch 36 on support base 34 and an opening 38 in the wall of member 14 enables the support to be maintained in its second inclined position. To pivot the support base 34 from the inclined position to the horizontal position, an opening 40 is provided in the wall of member 14 such that an individual may push and thereby pivot support base 34 into the horizontal position.

To provide support for the base 34 in the horizontal position, a plurality of tabs or inwardly directed flanges 42 are provided, preferably as continuations of the bottoms 16 of the plate body 12. Thus, tabs 42 as illustrated in FIG. 3 underlie the support base 34 when disposed in its first position illustrated in the full lines in FIG. 3. In an alternative form of the present invention, it will be appreciated that a pair of strips 46 may be pivoted to member 14 along orthogonally related sides of member 14 to form a cross-pattern at the base of member 14. The distal ends 48 of the strips 46 may be received in slots 50 formed in the lower wall of member 14 whereby the crossed strips 46 form a stop and a support for bottles or cans disposed in member 14.

Referring to FIG. 5, and in a further effort to accommodate variously sized beverage containers, there is illustrated a further form of the present invention wherein a stem glass having a bowl smaller in diameter than the diameter of the open upper end of member 14 may still be supported by the article hereof. To accomplish this, a slot 56 (FIG. 6) is formed through a side wall of the member 14 and is covered by a housing portion 58. The slot is further defined by an underlying support ledge 57. When the stem glass having the small bowl is inserted into member 14, its flat base can be disposed on the support base 34 at the bottom of the member 14 and a portion of the flat base may be received in the slot 56 also resting on ledge 57. This stabilizes the stem glass in member 14. Additionally, it will be appreciated that the closed housing 58 segregates the compartments of the plate body 12 from the base of the stem glass, thereby preventing spillage or leakage of food from plate body 12 onto the glass.

Referring to FIGS. 7–9, wherein like reference numerals as in the prior embodiments are applied to like parts, followed by the suffix "a", the member 14*a* has a plurality of inwardly directed, circumferentially spaced flutes 60 formed adjacent the base of member 14*a*. Slots 62 are also formed below the flutes 60. Thus, upon pivoting the support base 34*a* downwardly from its second position illustrated in FIG. 7 to its first position lying generally parallel to the bottom 16*a* of plate body 12*a*, the support base 34*a* will deform the flutes 60 in a generally outward direction such that the circumferential margin of the base 34*a* is received in the slots 62. Thus, the base 34*a* is maintained and supported in a horizontal position adjacent the base of member 14*a*.

It will be appreciated that the materials of the combined food plate and beverage holder article according to the present invention may vary. For example, stiff cardboard-type material may be used. Alternatively, plastic materials may be utilized or combinations thereof, such as a thin coating of plastic material over a cellulosic product.

In accordance with the present invention, it will be appreciated that each of the articles may be stacked relative to other articles. For example, in order to facilitate the transportation and storage prior to use of the combined food plate and beverage-holding article hereof, the member 14 of each article may be inserted into the larger diameter opening of corresponding member 14 of a superposed article whereby the articles may be nested or stacked one on top of the other. To facilitate this, the tabs 42 may be flexed or hinged upwardly to enable stacking or nesting with the conical member 14 inserted into an overlying member 14. When the plate is to be used, the tabs under the weight of the container will flex or hinge into a horizontal position to support the container.

In using the article of the present invention, it will be appreciated that the individual can simply grasp the member 14 which, in turn, will support the entirety of the plate from that one side. That is, with the use of reinforcing ribs 20 in the plate and notwithstanding the weight of food placed on the plate, the article hereof can be readily held and manipulated by grasping about member 14.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combination food plate and beverage-holding article comprising:

a plate body for supporting food and having a generally upstanding lip substantially about the margin of the body;

a beverage container support formed integrally with and upstanding from said body, said support including a generally truncated cone-shaped member having a wall portion adjacent said plate body larger in diameter than a diameter of an upper end portion of said member whereby a beverage container is at least in part receivable within said member through said upper end portion thereof;

said member being located off-center relative to said plate body and extending above the lip of the plate; and a support base carried by said article and movable between a non-supporting position for a beverage container received within said member and a beverage container support position within said member.

2. An article according to claim 1 wherein said member is open at both upper and lower ends thereof.

3. A combination food plate and beverage-holding article comprising:

a plate body for supporting food and having a generally upstanding lip substantially about the margin of the body; and a beverage container support carried by said body and including a generally truncated cone-shaped member having a wall portion adjacent said plate body larger in diameter than an upper end portion thereof and being open at both upper and lower ends thereof;

said member extending upwardly above said lip and being located off-center relative to said plate body sufficiently such that at least a portion of said member extending upwardly of the plate body can be grasped by an individual's fingers above the lip of the plate, thereby facilitating the carrying of the article with food on the plate and a beverage container in the beverage container support; and a support base carried by said article, said support base being movable between a position with the lower end of said member open and a position substantially closing said lower end of said member for supporting a beverage container in said beverage container support.

4. An article according to claim 3 wherein said support base is carried by said article for pivotal movement between said positions.

5. An article according to claim 4 wherein said support base in said member open in position lies retracted within said member, and a support carried by said article for supporting said base in said member closed position thereof and generally parallel to said plate body.

6. An article according to claim 4 wherein said support base in said member open position lies retracted within said member, and a catch cooperable between said support base and said member for releasably retaining said support base in said member open position.

7. An article according to claim 6 including an opening through said member for access to said support base in said member open position enabling said support base for movement from said member open position to said member closed position by inserting one or more of an individual's fingers through said opening to pivot said support base from said member open position into said member closed position.

8. An article according to claim 7 including a plurality of tabs adjacent the lower end of said member projecting inwardly to partially block said opening and provide support for said support base in said member closed position thereof.

9. An article according to claim 7 including slots through said member adjacent the lower end thereof and marginal portions of said support base being received in said slots in said member closed position of said support base to support the base in said member closed position thereof.

10. Nestable combination food plate and beverage-holding articles comprising:

a plurality of plate bodies for supporting food thereon, each said plate body having a generally upstanding lip substantially about the margin of said body and a beverage container support formed integrally with and upstanding from said body;

each said beverage container support including a generally truncated cone-shaped member having a wall portion adjacent said plate body larger in diameter than a diameter of an upper end portion thereof for carrying a beverage container receivable within said member through said upper end portion;

each said member extending upwardly above said lip and being located off-center relative to said plate body and lying adjacent a margin of the plate body;

a support base carried by each said article and movable between a non-supporting position for a beverage container received within said member and a beverage container support position within said member, each said member being nestable within another member of an adjacent article by insertion of the truncated cone-shaped members one into another with said support base in said non-supporting position whereby a plurality of said articles are stacked and nested.

11. A combination food plate and beverage-holding article comprising:

a plate body for supporting food and having a generally upstanding lip substantially about the margin of the body; and a beverage container support carried by said body and including a member generally upstanding from said plate body comprised of a surface of revolution open at its upper and lower ends;

said member extending upwardly above said lip and being located off-center relative to said plate body sufficiently such that at least a portion of said member extending upwardly of the plate body can be grasped by an individual's fingers above the lip of the plate, thereby facilitating the carrying of a plate with food thereon and a beverage container in the beverage container support; and a support base carried by said article, said support base being movable between a first position closing the opening therethrough at said lower end of said member for supporting a beverage container in said beverage container support and a second position opening the lower end of said member.

12. An article according to claim 11 wherein said support base is carried by said article for pivotal movement between said first and second positions.

13. An article according to claim 12 wherein said support base in said second position thereof lies retracted within said member, and a support carried by said article for supporting said base in said first position thereof and generally parallel to said plate body.

14. An article according to claim 12 wherein said support base in said second position lies retracted within said member, and a catch cooperable between said support base and said member for releasably retaining said support base in said second position.

15. An article according to claim 14 including an opening through said member for access to said support base in said second position thereof enabling said support base for movement from said second position to said first position by inserting one or more of an individual's fingers through said opening to pivot said support base from said second position into said first position.

16. An article according to claim 15 including a plurality of tabs adjacent the lower end of said member projecting inwardly to partially block said opening and provide support for said support base in said first position thereof.

17. An article according to claim 16 including slots through said member adjacent the lower end thereof and marginal portions of said support base being received in said slots in said first position of said support base to support the base in said first position thereof.

18. An article according to claim 11 wherein said member has a slot opening laterally thereof and a support ledge in part defining said slot, said ledge lying along one side of said member enabling insertion of a portion of a generally flat base of a stem glass into said slot for supporting the stem glass from said ledge.

19. A combination food plate and beverage-holding article comprising:

a plate body for supporting food and having a generally upstanding lip substantially about the margin of the body; and a beverage container support carried by said body and including a generally truncated cone-shaped member having a wall portion adjacent said plate body larger in diameter than an upper end portion thereof;

said member extending upwardly above said lip and being located off-center relative to said plate body sufficiently such that at least a portion of said member extending upwardly of the plate body can be grasped by an individual's fingers above the lip of the plate, thereby facilitating the carrying of the article with food on the plate and a beverage container in the beverage container support, said member having a slot opening laterally thereof and a support ledge in part defining said slot, said ledge lying along one side of said member enabling insertion of a portion of a generally flat base of a stem glass into said slot for supporting the stem glass from said ledge.

20. An article according to claim 1 wherein said member upstands from said plate body a distance several times the height of the plate body lip and located off-center such that at least a portion of said member extending upwardly of said plate body can be grasped by an individual's fingers, thereby facilitating the carrying of the article with food on the plate body and a beverage container in the beverage container support.

21. An article according 1 wherein said member defines an opening therethrough, said support base being movable between a retracted position wherein said opening is substantially unobstructed and an extended position at least partially blocking said opening for supporting a beverage container received in said opening.

22. An article according to claim 1 including a pair of support bases carried by said article and movable between non-supporting positions for a beverage container received within said member through said upper end portion thereof and a beverage container support position within said member.

23. A combination food plate and beverage-holding article comprising:

a plate body for supporting food and having a generally upstanding lip substantially about the margin of the body;

a beverage container support formed integrally with and upstanding from said body, said support including a generally truncated cone-shaped member having a wall portion adjacent said plate body larger in diameter than a diameter of an upper end portion of said member whereby a beverage container is at least in part receivable within said member through said upper end portion thereof;

said member being located off-center relative to said plate body and extending above the lip of the plate; and a pair of support bases carried by said article and movable between non-supporting positions for a beverage container received within said member through said upper end portion thereof and beverage container support positions within said member.

* * * * *